US005666024A

United States Patent [19]

Vickers

[11] Patent Number: 5,666,024

[45] **Date of Patent: *Sep. 9, 1997**

[54] LOW CAPACITANCE FIELD EMISSION DEVICE WITH CIRCULAR MICROTIP ARRAY

[75] Inventor: Kenneth G. Vickers, Whitesboro, Tex.

[73] Assignee: Texas Instruments Incorporated, Dallas, Tex.

[ * ] Notice: The term of this patent shall not extend beyond the expiration date of Pat. No. 5,635,791.

[21] Appl. No.: 518,909

[22] Filed: Aug. 24, 1995

Related U.S. Application Data

[60] Provisional application No. 60/000,485, Jun. 23, 1995.

[51] Int. Cl.[6] ..... H01J 1/62; H01J 63/04; H01J 1/16; H01J 1/53

[52] U.S. Cl. ..... 313/494; 313/309; 313/336; 313/351

[58] Field of Search ..... 313/309, 310, 313/336, 351, 495, 496, 497, 346 R

[56] References Cited

U.S. PATENT DOCUMENTS

| | | | |
|---|---|---|---|
| 3,745,402 | 7/1973 | Shelton et al. . | |
| 3,755,704 | 8/1973 | Spindt et al. | 313/309 |
| 3,812,559 | 5/1974 | Spindt et al. | 29/25.18 |
| 4,818,914 | 4/1989 | Brodie . | |
| 4,857,161 | 8/1989 | Borel et al. | 204/192.26 |
| 4,940,916 | 7/1990 | Borel et al. | 313/306 |
| 5,194,780 | 3/1993 | Meyer | 315/35 |
| 5,225,820 | 7/1993 | Clerc | 340/752 |
| 5,534,744 | 7/1996 | Leroux et al. | 313/309 |

FOREIGN PATENT DOCUMENTS

| | | |
|---|---|---|
| 2687839 | 8/1993 | France . |

*Primary Examiner*—Sandra L. O'Shea
*Assistant Examiner*—Mark Haynes
*Attorney, Agent, or Firm*—Warren L. Franz; Wade James Brady, III; Richard L. Donaldson

[57] ABSTRACT

An electron emitter plate (110) for an FED image display has an extraction (gate) electrode (122, 222) spaced by a dielectric insulating layer (25) from a cathode electrode including a conductive mesh (118, 218). Circular arrays (112) of microtips (14) are located concentrically within mesh spacings (116, 216) on a resistive layer (15), within apertures (26) formed on ring-shaped pads (127, 227) patterned in an extraction electrode (122). Mesh spacings (116) and pads (127) are circular. Mesh spacings (226) and pads (227) are hexagonal. For reduced capacitance, dielectric material (25) is etched from cores (144) of rings (127, 227) and from toroidal regions (148) below rings (127, 227). Mesh spacings (116, 216) are hexagonal close-packed and mesh material (118, 218) is removed from portions (142) of cathode electrode. Y-shaped bridging strips (129') have nodes (146) located over removed cathode electrode portions (142).

25 Claims, 6 Drawing Sheets

LOW CAPACITANCE FIELD EMISSION DEVICE WITH CIRCULAR MICROTIP ARRAY

This application claims priority under 35 §119(c)(1) of provisional application number 60/000,485, filed Jun. 23, 1995.

CROSS-REFERENCE TO RELATED APPLICATION

This application relates to similar subject matter as Applicant's U.S. Ser. No. 518,829 now U.S. Pat. No. 5,635,791, entitled "Field Emission Device with Circular Microtip Array," filed on even date herewith.

TECHNICAL FIELD OF THE INVENTION

The present invention relates generally to electron emitting structures of the field emission type; and, in particular, to improved microtip emission cathode structures and FED field emission flat-panel image display devices utilizing such structures.

BACKGROUND OF THE INVENTION

Examples of conventional electron emitting devices of the type to which the present invention relates are disclosed in U.S. Pat. Nos. 3,755,704; 3,812,559; 4,857,161; 4,940,916; 5,194,780 and 5,225,820. The disclosures of those patents are incorporated herein by reference.

Microtip emission cathode structures usable in FED field emission flat-panel image display devices, as described in the referenced patents, typically comprise thin film metal/insulator/metal sandwich structures deposited on a glass or silicon support substrate. In a usual self-aligning method of fabrication, first and second conductive layers are deposited on the substrate, separated by an intervening dielectric insulating layer which functions to space and insulate the conductive layers. The bottom conductive layer functions as the emitting or cathode electrode. The top conductive layer functions as the extractor or gate electrode. Apertures are formed in the top conducting layer and in the intervening dielectric material, and a microtip emitter (sometimes called an electron field emitting spike, needle or protuberance) is formed within each aperture in electrical communication with the bottom conductive layer. Traditional designs have placed the emitters in either random or rectangular matrix arrays.

Early implementations formed the microtips directly on the lower or cathode electrode. Such arrangements, however, provided little protection against excessive current draw. The use of a resistive layer was therefore proposed to provide a ballast against excessive current in each microtip emitter, and consequently to homogenize the electron emission. The Borel, et al. '916 patent describes the use of a resistive layer above the cathode electrode and beneath the microtips. Such vertical resistor approach helps eliminate nonuniformity caused by excessively bright spots and reduces breakdown risk at the microtips by limiting current flow when local short-circuiting occurs between individual microtips and the gate. Under the Borel approach, however, when a short circuit occurs between a microtip and the gate, the full voltage applied between the gate and cathode conductors is applied vertically across the resistive coating. This requires the resistive coating to be thick enough to withstand the full gate-to-cathode voltage without breaking down due to heat. Thus, the existence of "pinhole" or other defects which locally reduce thickness of the resistive layer will lead to breakdown.

The Meyer '780 patent overcomes this deficiency by use of a lateral resistor cathode structure for a field emission device. A plurality of arrays of electrically conductive microtips are formed on a resistive layer, within respective mesh spacings of a conductive layer which is patterned into a mesh structure configuration. This arrangement provides an improvement in breakdown resistance of a field effect emissive device, without requiring increasing the thickness of the resistive layer. The mesh-like structure of the cathode conductor (and/or the gate conductor), permits the cathode conductor and the resistive coating to lie substantially in the same plane. In such configuration, the breakdown resistance is no longer susceptible to defects in the vertical thickness of the resistive coating, because it is the lateral separation of the microtips from the cathode conductor by the resistive coating which provides the ballast against excessive current. It is, therefore, sufficient to maintain a horizontal distance between the cathode conductor and the microtip which is adequate to prevent breakdown, while still retaining a homogenization effect for which the resistive coating is supplied.

In both the '916 and '780 approaches, the ballast is in the form of a resistive voltage drop, such that those microtips drawing the most current have the greatest resistive drop, thus acting in such a way as to limit microtip current. An equivalent circuit of the '916 or '780 ballast arrangement would have each tip in series with an individual buffer resistor to limit the field emission current. However, the ballast resistance between the microtips and the cathode conductor varies with the position of the individual microtip within the array. In a four-by-four rectangular matrix array, for example, a microtip in the corner of the array has a lower ballast resistance than a microtip at the side of the array, and a microtip in the side has a lower ballast resistance than a microtip in the interior. The difference in ballast resistance among microtips becomes even more pronounced as the size of the array or the spacing between microtips increases. Thus, an arrangement is desired which will enable all microtips to be substantially equal potential.

Applicant's Copending Application

Applicant's copending application U.S. Ser. No. 08/518,829, entitled "Field Emission Device With Circular Microtip Array," filed on even date herewith, addresses this problem by providing a subpixel mesh electron emitter plate structure having microtips arranged in circular arrays concentrically within the mesh spacings. The microtips are laterally spaced from the mesh structure by substantially identical paths of the resistive layer, placing all microtips at substantially the same potential. The full disclosure of that application is incorporated herein by reference.

An FED (field emission device) flat-panel image display device of the type described in the '829 application is shown in FIGS. 1–3. Such device includes an electron emitter plate 10 spaced across a vacuum gap from an anode plate 11 (FIG. 1). Emitter plate 10 comprises a cathode electrode having a plurality of circular arrays 12 of electrically conductive microtips 14 formed on a resistive layer 15, within respective circular mesh spacings 16 (FIG. 2) of grid mesh structure 18, patterned in stripes 19 (referred to as "columns") (FIG. 3) on an upper surface of an electrically insulating silicon substrate or glass substrate 20 overlaid with a thin silicon dioxide ($SiO_2$) film 21. An extraction (or gate) electrode 22 (FIGS. 1 and 2) comprises an electrically conductive layer of cross-stripes 24 (referred to as "rows") (FIG. 3) deposited on an insulating dielectric layer 25 which serves to insulate electrode 22 and space it from the resistive and conductive layers 15, 18. Microtips 14 are in the shape of cones which are formed within apertures 26 through conductive layer 22 and concentric cavities 41 of insulating layer 25. The microtips 14 are formed utilizing a variation of the self-alignment microtip formation technique described in Spindt U.S. Pat. No. 3,755,704 and Meyer U.S. Pat. No. 5,194,780, wherein apertures 26 and cavities 41 are etched after deposition of layers 22, 25 and wherein a respective microtip 14 is formed within each aperture 26 and cavity 41. The relative parameters of microtips 14, insulating layer 25 and conductive layer 22 are chosen to place the apex of each microtip 14 generally at the level of layer 22 (FIG. 1). Electrode 22 is patterned to form circular islands or pads 27 located concentrically within the mesh spacings 16, and to remove truncated triangular-shaped areas 28 (FIG. 2) at the centers of triplets of the pads 27. Apertures 26 are preferably formed at equiangular spacings about circles 17 located concentrically on the pads 27. Bridging strips 29 of electrode 22 are left for electrically interconnecting neighboring pads 27 of the same row cross-stripe 24.

Anode plate 11 (FIG. 1) comprises an electrically conductive layer of material 31 deposited on a transparent insulating glass or silicon substrate 32, which is positioned facing extraction electrode 22. The conductive layer 31 is deposited on an inside surface 33 of substrate 32, directly facing gate electrode 22. Conductive layer 31 is typically a transparent conductive material, such as indium-tin oxide (ITO). Anode plate 11 also comprises a coating of phosphor cathodoluminescent material 34, deposited over the conductive layer 31, so as to be directly facing and immediately adjacent extraction electrode 22.

In accordance with conventional teachings, groupings of the microtip arrays 12 in mesh spacings 16 corresponding to a particular column-row image pixel location can be energized by applying a negative potential to a selected column stripe 19 (FIG. 3) of cathode mesh structure 18 relative to a selected row cross-stripe 24 of extraction electrode 22, via a voltage source 35, thereby inducing an electric field which draws electrons from the associated subpixel arrays of microtips 14. The freed electrons are accelerated toward the anode plate 11 which is positively biased by a substantially larger positive voltage applied relative to extraction electrode 22, via the same or a different voltage source 35. Energy from the electrons emitted by the energized microtips 14 and attracted to the anode electrode 31 is transferred to particles of the phosphor coating 34, resulting in luminescence. Electron charge is transferred from phosphor coating 34 to conductive layer 28, completing the electrical circuit to voltage source 35.

The various column-row intersections of stripes 19 of cathode mesh structure 18 and cross-stripes 24 of extraction electrode 22 are matrix-addressed to provide sequential (typically, row-at-a-time) pixel illumination of corresponding phosphor areas, to develop an image viewable to a viewer 36 looking at the front or outside surface 37 of the plate 11. However, even with row-at-a-time addressing, the per pixel addressing duty factor is small. For example, the pixel dwell time (fraction of frame time available to excite each pixel) for row-at-a-time addressing in a 640×480 pixel color display refreshed at 60 frames per second (180 RGB color fields per second), is only about 8–10 microseconds per row. This means that for pulsewidth modulated gray scale control, where the dwell time per pixel is further divided into as many as 64 dwell time subintervals, column voltage switching during row "on" times occurs at the rate of about once every 30–40 nanoseconds. At such high switching rates, total gate-to-cathode capacitance for the column stripes 19 becomes a significant factor in the RC time constant and has a predominant adverse influence on the $\frac{1}{2}CV^2$ power consumption factor. Some reduction in capacitance is achieved through the described patterning of gate electrode 22, wherein pads 27 do not overlap mesh structure 18 and removal of gate electrode from areas 28 reduces capacitance away from the microtips. There remains, however, a pressing need to reduce the column gate-to-cathode capacitance even more in such field effect devices.

SUMMARY OF THE INVENTION

The invention provides an electron emitting structure of the field emission type having reduced cathode-to-gate capacitance. The invention also provides a display utilizing such structure.

An electron emitter plate has a metal/insulator/metal sandwich structure comprising layers of conductive material deposited on a substrate and separated by an intervening layer of dielectric insulating material. The first conductive layer is patterned in a mesh structure, providing mesh spacings. The second conductive layer has apertures arranged within the mesh spacings, and microtips are formed within the apertures. A layer of resistive material laterally spaces the microtips from the surrounding mesh structure.

In one aspect of the invention, the apertures are arranged in loops or circles and the second conductive layer is patterned to remove metallization from within the centers of the loops or circles.

In another aspect of the invention, the second layer is patterned to form ring-shaped pads located centrally of the mesh spacings. The apertures are formed on the rings, and the ring centers are left free of metallization. The insulating layer is, optionally, etched to reduce its thickness within the ring centers. The insulating layer may also be etched, exaggerating an undercut below the apertures, to remove insulating material from toroidal regions separating undersurfaces of pad tings from underlying portions of the resistive layer. Such exaggerated undercutting forms cavities connecting apertures and commonly containing pluralities of microtips, thereby reducing capacitance by further eliminating dielectric material. Disclosed examples include circular ring pads placed within circular mesh spacings, and hexagonal ring pads placed within hexagonal mesh spacings.

In yet another aspect of the invention, the mesh spacings are arranged in hexagonal close-packed relationships, wherein lines joining centers of the mesh spacings form equilateral triangles, and the first conductive layer is patterned to remove first layer conductive material from the centers of the triangles.

In yet another aspect of the invention, the second layer is patterned to form pads, with bridging strips joining each pad with at least two other pads. The bridging strips can be arranged so that centers of the strips pass over removed portions of the first conductive layer.

BRIEF DESCRIPTION OF THE DRAWINGS

Embodiments of the invention have been chosen for the purpose of illustration and description, and are shown with reference to the accompanying drawings, wherein:

FIG. 1 is a view of the display corresponding to a section taken along the line 1–1 of FIG. 2;

FIG. 2 is a top plan view of a portion of a pixel of the image forming area of the cathode plate of the display; and FIG. 3 is a schematic macroscopic top view of a corner of the cathode plate useful in understanding the row-column, pixel-establishing intersecting relationships between the cathode grid and pad-patterned gate electrodes shown in greater enlargement in FIG. 2.

FIGS. 4–9 illustrate embodiments of the invention.

FIG. 4 is a view, similar to that of FIG. 1 and corresponding to a section taken along the line 4—4 of FIG. 5, of a display incorporating an electron emitting structure in accordance with the invention;

FIG. 5 is a view, similar to that of FIG. 2, of the display of FIG. 4;

FIG. 6 is a view, similar to that of FIG. 5, of a modified form of the display of FIGS. 4 and 5;

FIG. 8 is a section view, similar to that of FIG. 4 and corresponding to a section taken along the line 8—8 of FIG. 7C; and FIG. 9 is a view, corresponding to FIG. 5, of an alternative embodiment of the invention.

Throughout the drawings, like elements are referred to by like numerals.

DETAILED DESCRIPTION OF PREFERRED EMBODIMENTS

Figure 4:
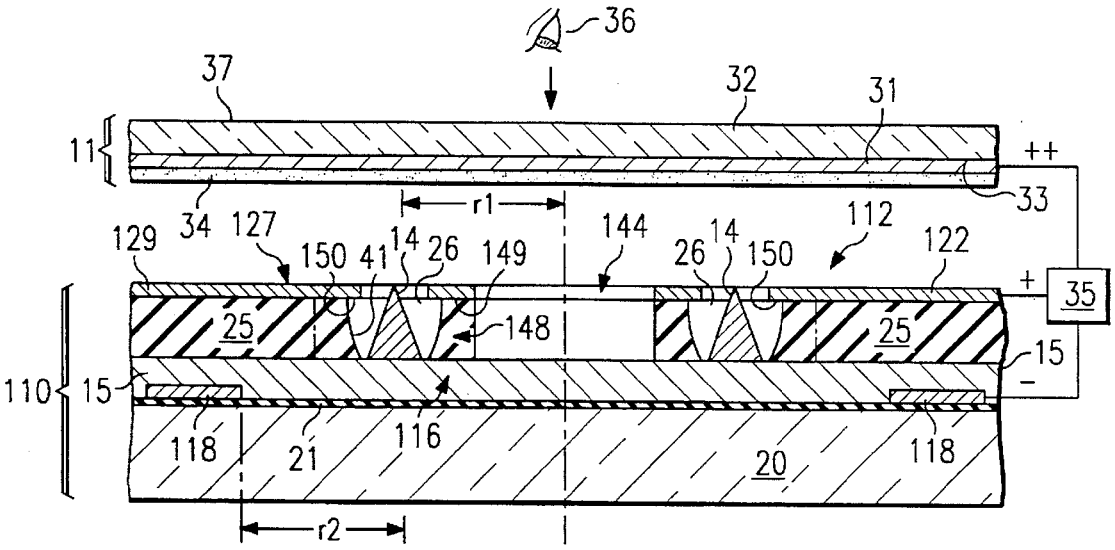
Figure 5:
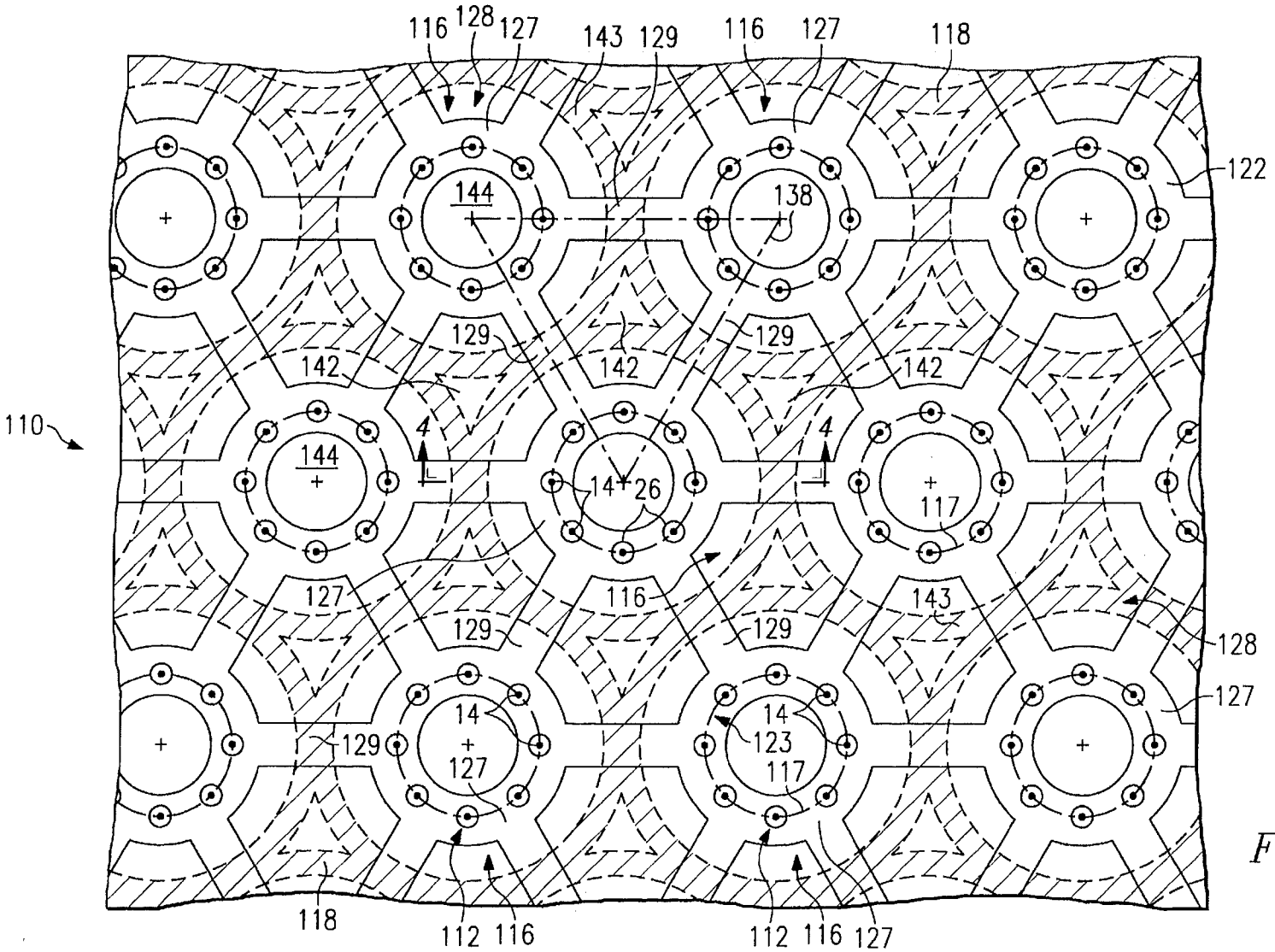

FIGS. 4 and 5 illustrate an embodiment of an FED flat-panel image display device, incorporating an electron emitter plate 110 fabricated in accordance with the teachings of the present invention.

Figure 1:
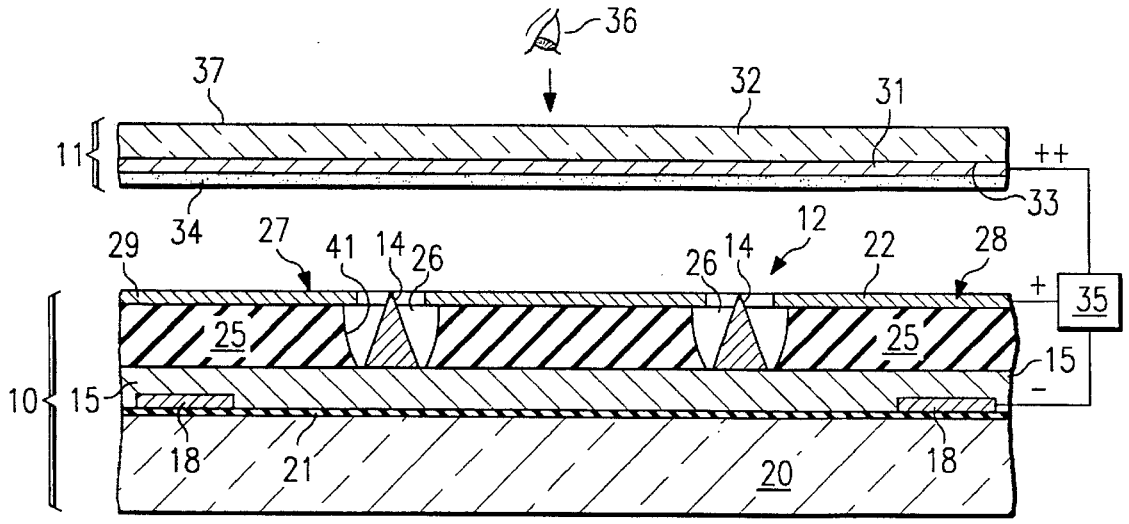
FIGS. 1–3, already described, illustrate an electron emitting structure of the field emitting type, as disclosed in Applicant's copending application U.S. Ser. No. 08/518,829, entitled "Field Emission Device With Circular Microtip Array," filed on even date herewith.
Figure 2:
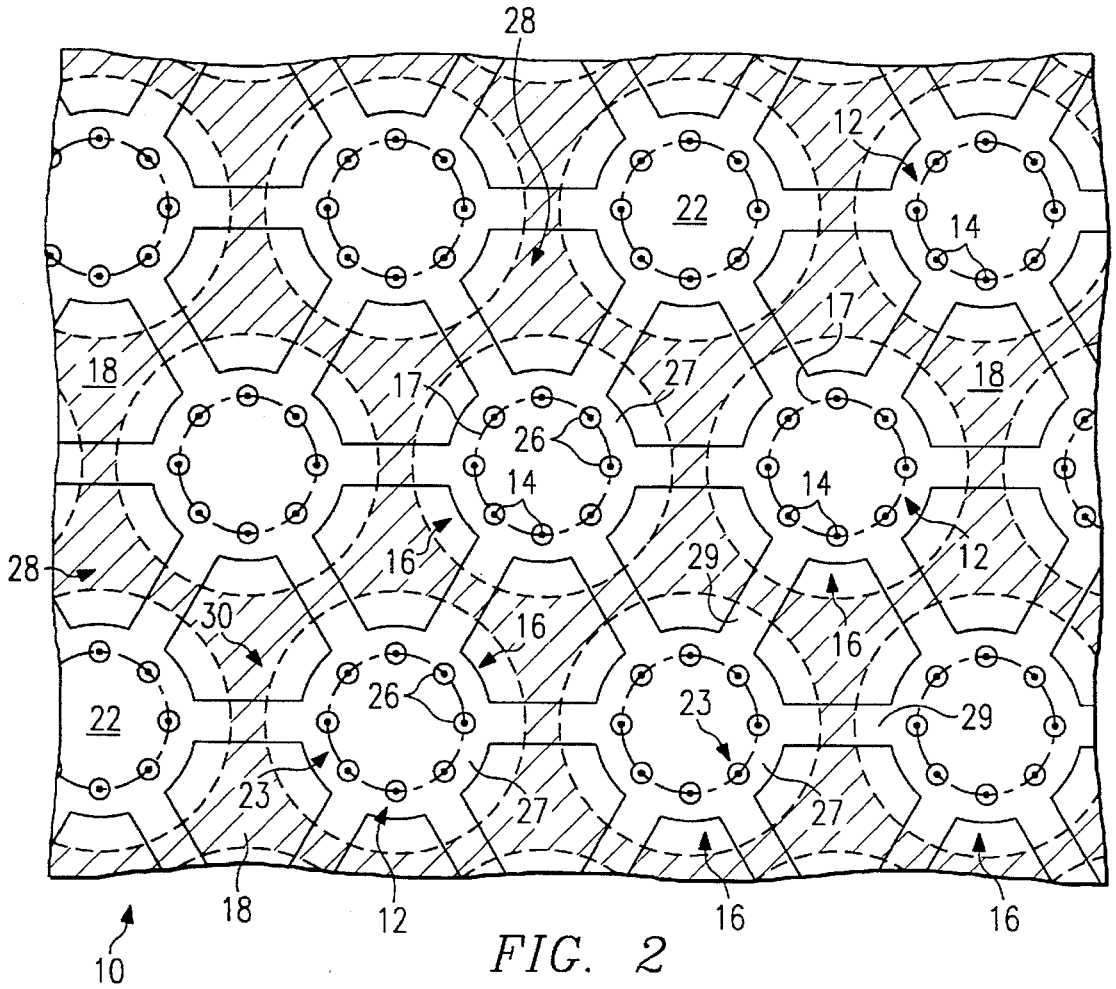
Figure 3:
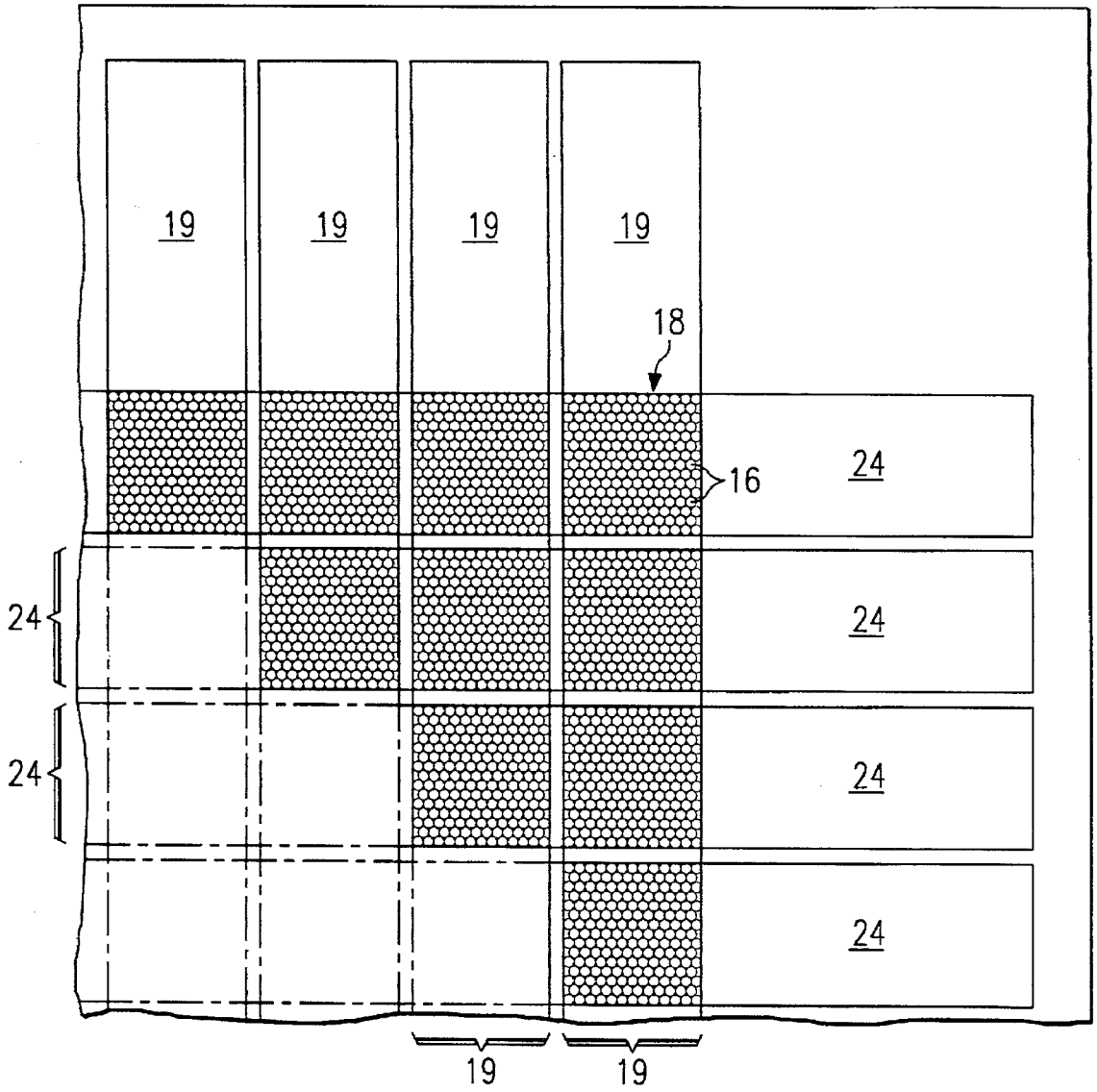

As with the device of FIGS. 1–3, the emitter plate 110 is spaced across a vacuum gap from an anode plate 11, which may be identical to the anode plate 11 previously described. Likewise, as with the previously described emitter plate 10 (see FIG. 2), emitter plate 110 comprises a cathode electrode having a plurality of clusters of similar electrically conductive microtips 14 formed in circular arrays 112 on a resistive layer 15 (see FIG. 4) within respective circular mesh spacings 116 (shown in dashed lines in FIG. 5) of a conductive layer mesh structure 118 patterned in column stripes 19 (see FIG. 3) on an upper surface of a glass or other substrate 20. Arrays 112 of microtips 14 are preferably located concentrically within the mesh spacings 116. Such positioning places each microtip 14 on a circle 117, at an identical radial distance r1 from the center of a circular spacing 116 and at an identical radial distance r2 from the circumference of the circular spacing 116 (see FIG. 4). All microtips 14 of the same circle 117 are, thus, laterally spaced by the same ballast resistive path from the mesh structure 118.

Emitter plate 110 has a second conductive layer forming an extraction (or gate) electrode 122 deposited on the substrate 20 and spaced by and insulated from the resistive layer 15 and cathode mesh structure 118 by an intervening dielectric insulating layer 25 (see FIG. 4). Electrode 122 is patterned to form circular ring-shaped aperture islands or pads 127, each having a circular array 123 of apertures 26 arranged in one-to-one correspondence with the microtips 14 of a corresponding array 112 and located concentrically within a respective circular mesh spacing 116. Such patterning reduces the mount of metallization overlap between electrode 122 and mesh structure 118 and the amount of metalization of electrode 122 within the mesh spacing 116, thereby reducing the capacitance of the overall structure. The respective radii of mesh spacings 116 and pads 127 are chosen to leave an annular gap between the circumferences of pads 127 and the mesh spacings 116. The extraction electrode 122 comprises an electrically conductive layer of row-defining cross-stripes 24 (see FIG. 3) that run transversely to stripes 19 defined by the cathode electrode mesh structure 118. Electrical communication between neighboring pads 127 of the same cross-stripe 24 is established by means of radially extending, spoke-like bridging strips 129, left between pads 127 in the patterning of conductive layer 122.

As shown in FIG. 5, the mesh spacings 116 are arranged in hexagonal close-packed relationships, so that lines joining centers of the mesh spacings 116 form equilateral triangles 138 (shown in dot-dashed lines in FIG. 5). The illustrated bridging strips 129 are generally coincident with the sides of triangles 138. Electrode 122 is patterned to remove truncated triangular-shaped areas of metalization 128 within triangles 138, in areas defined between outer boundaries of rings 127 and facing sides of bridging strips 129. To further reduce capacitance, triangular portions 142 of mesh structure 118 are removed at the centers of equilateral triangles 138 (also the centers of triangular-shaped areas 128), giving the remaining mesh structure 118 the appearance of a gridwork of tangentially joined circular bands 143. Gate electrode 122 is patterned to remove metalization from the circular cores or ring centers 144 defined by the inner boundaries of ting-shaped pads 127. This removes a majority of the gate electrode material from the interior of the loop formed by the circular array 123 of apertures 26. For further reduction in capacitance, cores 144 can optionally be subjected to further etching to reduce the thickness of insulating material layer 25 within ring centers 144. FIG. 4 illustrates the case where insulating material 25 has been removed in its entirety from within core 144.

Figure 6:
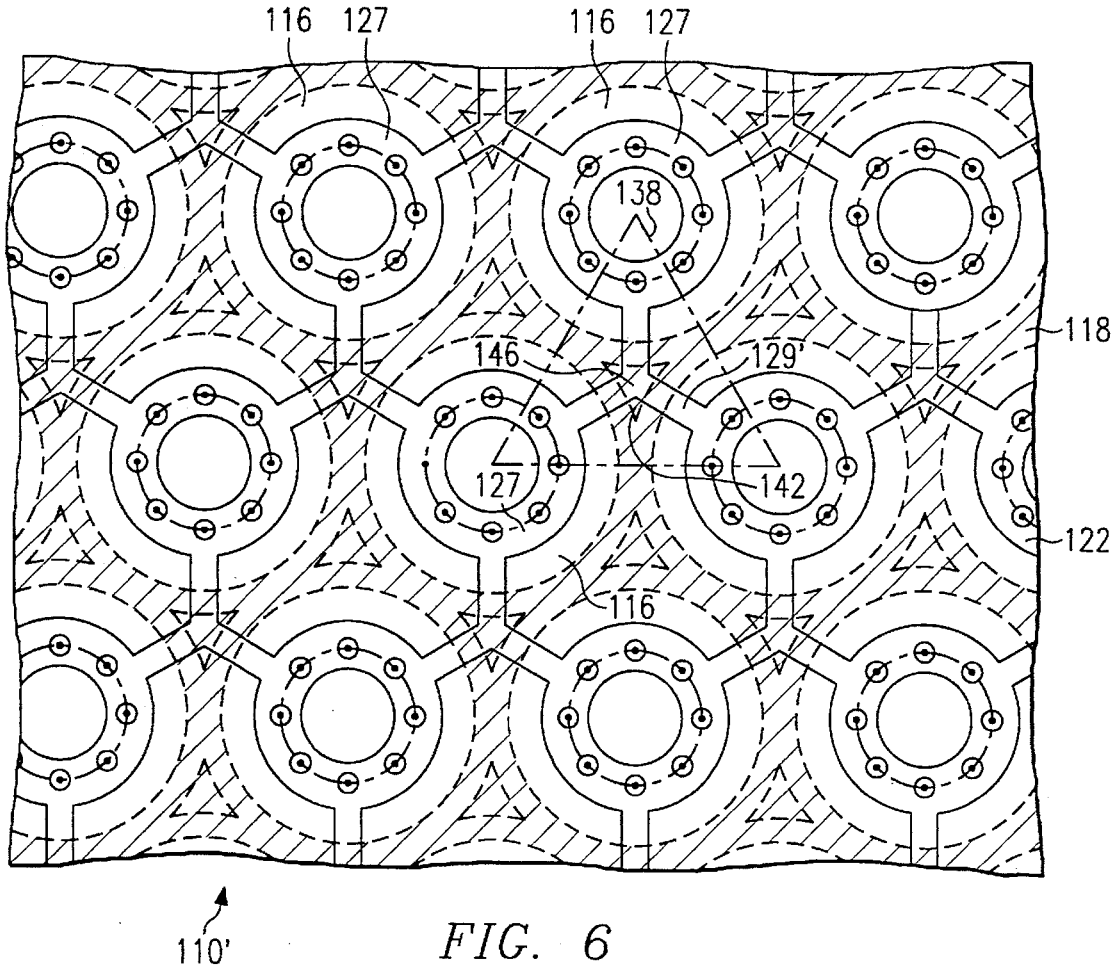

FIG. 6 illustrates a modified electron emitter plate 110' wherein ring-shaped pads 127 are electrically connected by bridging strips 129', not coincident with the sides of equilateral triangles 138 joining the centers of mesh spacings 116. The bridging strips 129' are Y-shaped strips having central nodes 146 which pass over the centers of triangles 138 from which portions 142 of the mesh structure 118 have been removed. Because each bridging strip 129' connects three pads 127, fewer bridging strips 129' are utilized. The illustrated embodiment shows circular ring-shaped pads 127 joined to other pads 127 by three bridging strips 129' equiangularly-spaced at 120° intervals about pads 127. The arrangement of FIG. 5, on the other hand, shows each pad 127 joined to other pads 127 by six bridging strips 129, spaced at 60° intervals. Moreover, with the removal of cathode electrode metalization portions 142 from the mesh structure 118, bridging strips 129 of electrode 122 overlap less mesh structure 118 metalization per pad 127, than bridging strips 129.

Figure 7A:
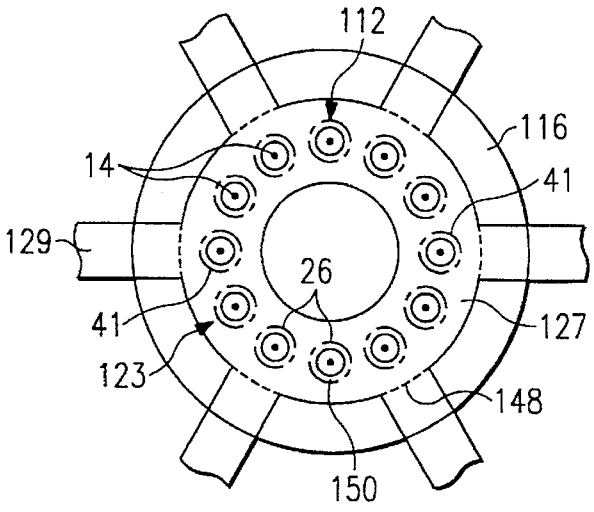
FIGS. 7A–7C are schematic views of different microtip emitter arrays usable in the displays of FIGS. 5 and 6.
Figure 7B:
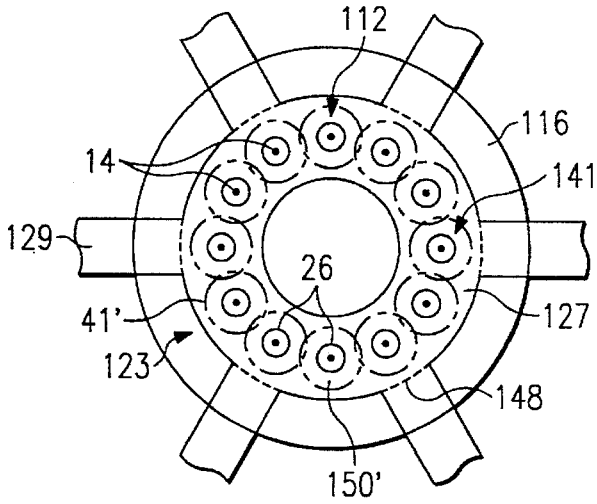
Figure 7C:
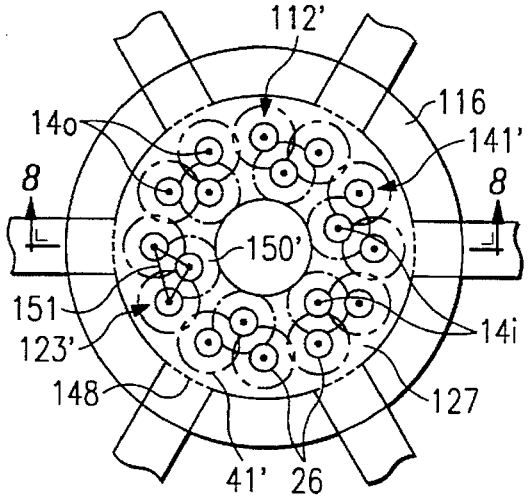

FIGS. 7A–7C show various configurations for the microtip arrays 112. FIG. 7A has 12 apertures 26 arranged in a loop, at equiangular spacings about a ring-shaped pad 127. Similar to the arrangement of FIGS. 4 and 5, a microtip 14 is formed within each aperture 26 to occupy a respective cavity 41 (see FIG. 4), indicated in dot-dashed lines in FIG. 7A. In this arrangement, a toroidal region 148 (FIG. 4), which separates an undersurface 149 of ring 127 from resistive layer 15, is occupied by dielectric material of insulating layer 25, except at cavities 41 which are the same diameter (except for slight undercut at 150) as the apertures 26. Each cavity 41 is associated with one aperture 26 and contains one microtip 14.

FIG. 7B shows the same looped array 112 of microtips 14 in one-to-one correspondence with apertures 26 of the same aperture array 123. However, in the FIG. 7B arrangement, the layer 25 (FIG. 2) has been further etched to provide an exaggerated undercut 150'. The cavities 41' have been expanded into overlapping volumes, communicating them to form a single larger ring-shaped cavity 141, connecting the apertures 26 of array 123 and commonly containing the microtips 14 of array 112. In FIG. 7B, the dielectric material of layer 25 is now absent from the majority of the torodial region 148, thereby substituting the lower dielectric constant of air (viz. vacuum) for the higher dielectric constant of the removed material 25.

Figure 8:
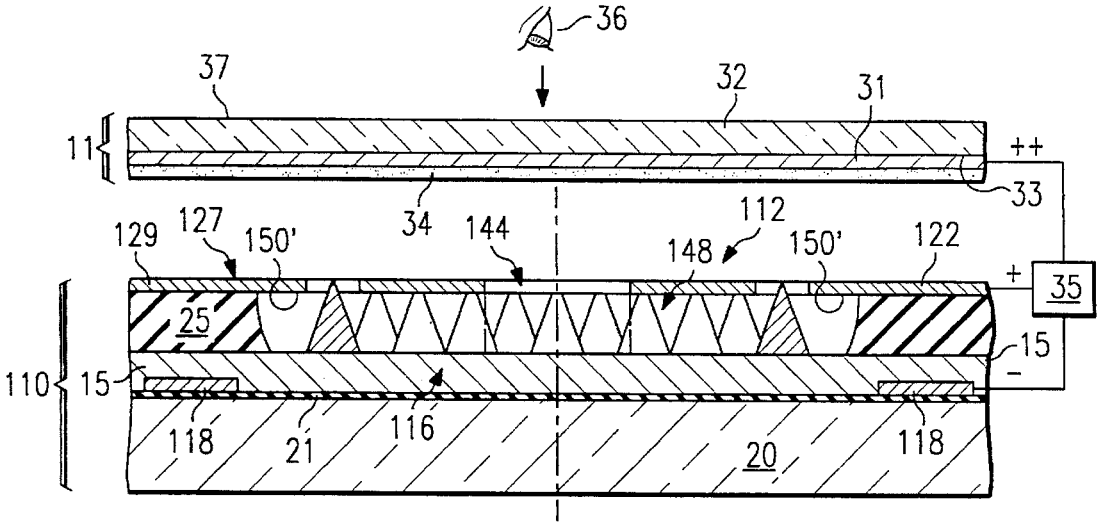

FIGS. 7C and 8 show an array 123' of apertures 26 and corresponding array 112' of microtips 14, wherein an inside loop of microtips **14*i* is added within an outside loop of microtips 14*o* on the same ring-shaped pad 127. Each microtip 14*i* is placed on the inside loop, at every other location between each pair of microtips 14*o* of the outer loop, so that lines joining the centers of each microtip 14*o*, 14*i* triplet will form an equilateral triangle 151. This corresponds to the arrangement described in Applicant's copending '829 application wherein a secondary circle of microtips is located within a primary circle of microtips. As with the FIG. 7B arrangement, described above, an enlarged undercut 150' is obtained through exaggerated etching, thereby overlapping and communicating cavities 41' to form a single larger cavity 141 within torodial region 148. As shown in FIG. 8, the reduction of dielectric material 25 in torodial region 148 below ring 127 can be combined with the previously discussed reduction in dielectric material 25 in the ring's center 144, thereby extending cavity 141' to encompass all but a peripheral support portion of the volume of layer 25 contained within the outer boundary circumference of pad 127. This leaves pad 127 marginally supported at its outer boundary periphery and replaces the dielectric constant of material 25 with the lower dielectric of air (viz. vacuum) in the vicinity of microtips 14**. This reduces the total capacitance of the emitter plate.

The size of apertures 26 in the arrangement of FIGS. 4 and 5 can be the same as the size of apertures 26 in the arrangement of FIGS. 1–3, and similar self-alignment techniques can be used to obtain an initial alignment for forming microtips 14 in general concentric alignment within apertures 26. A process for fabrication of thin-film microtip emission cathode structures of the type shown in FIGS. 1–3 is generally described in Applicant's copending '829 application. Patterning modifications can be made and initial etching steps introduced, as necessary, to produce the described embodiments.

A cathode mesh structure 118, resistive layer 15, dielectric insulating layer 25 and gate electrode layer 122 (FIG. 4) are successively formed on an upper surface of a glass or silicon substrate 20. The cathode structure 118 may, for example, be formed by depositing a thin coating of conductive material, such as niobium, over the substrate 20. The circular mesh pattern of structure 118 and patterns defining the columns 19 may then be produced in the conductive coating by photolithography and etching to give the mesh-defining bands 143 (see FIG. 5), providing a hexagonal close-packed arrangement of circular mesh spacings 116 and removing metal from triangular portions 142. Resistive layer 15 may, for example, be formed as a resistive, undoped silicon coating deposited by cathode sputtering or chemical vapor deposition over the patterned conductive layer 118. Alternatively, resistive layer 15 can be deposited first, before deposition of the conductive cathode structure layer 118. Spacer layer 25 may then, for example, be formed as a silicon dioxide ($SiO_2$ layer deposited by chemical vapor deposition over the patterned mesh structure 118, with the resistive coating 15 left exposed within the mesh spacings 116. Gate electrode layer 122 may then be formed by depositing, for example, a thin metal coating of niobium over the spacer layer 25.

Next, gate layer 122 is masked and etched to define apertures 26 arranged in circular arrays. The insulating layer 25 is also etched to form cavities 41 (FIG. 4) in alignment with apertures 26. Thereafter, while rotating the substrate 20, a sacrificial lift-off material layer of, e.g., nickel is deposited by low-angle electron beam deposition over layer 122. The beam is directed at an angle of 5°–20° to the surface (70°–85° from normal) so as to deposit lift-off layer material on the circumferential walls of apertures 26. Then, with substrate 20 again being rotated, molybdenum and/or other conductive tip forming material is deposited on the resistive layer 15 inside the cavities 41 by directing a beam substantially normal to the apertures 26 to form pluralities of arrays of microtips 14, self-aligned in respective concentric alignment within the apertures 26 and cavities 41. The nickel lift-off layer is then removed, together with the superfluous molybdenum deposited over the nickel. Subsequent masking and etching is used to pattern the apertured layer 122, to define the row cross-stripes 24 (see FIG. 3), the pads 127 and the bridging strips 129 (see FIG. 5).

For reduction of dielectric material in the torodial regions 148, the dielectric layer 25 can be subjected to additional etching to expand the cavities 41 into overlapping cavities 41', either prior to microtip formation or thereafter. For reduction of dielectric material in the ring centers 144, the apertured layer 122 can be patterned in two steps. First, the ring centers 144 are defined. Then, a dielectric material etching step is performed. The rest of the ring-shaped pads 127 and bridging strips 129 are patterned thereafter. If the exaggerated undercut 150' which gives the single larger cavity 141 in torodial region 148 is performed after formation of microtips 14, that step can be combined with the removal of dielectric material 25 from the ring centers 144 after the pad centers have been defined.

Figure 9:
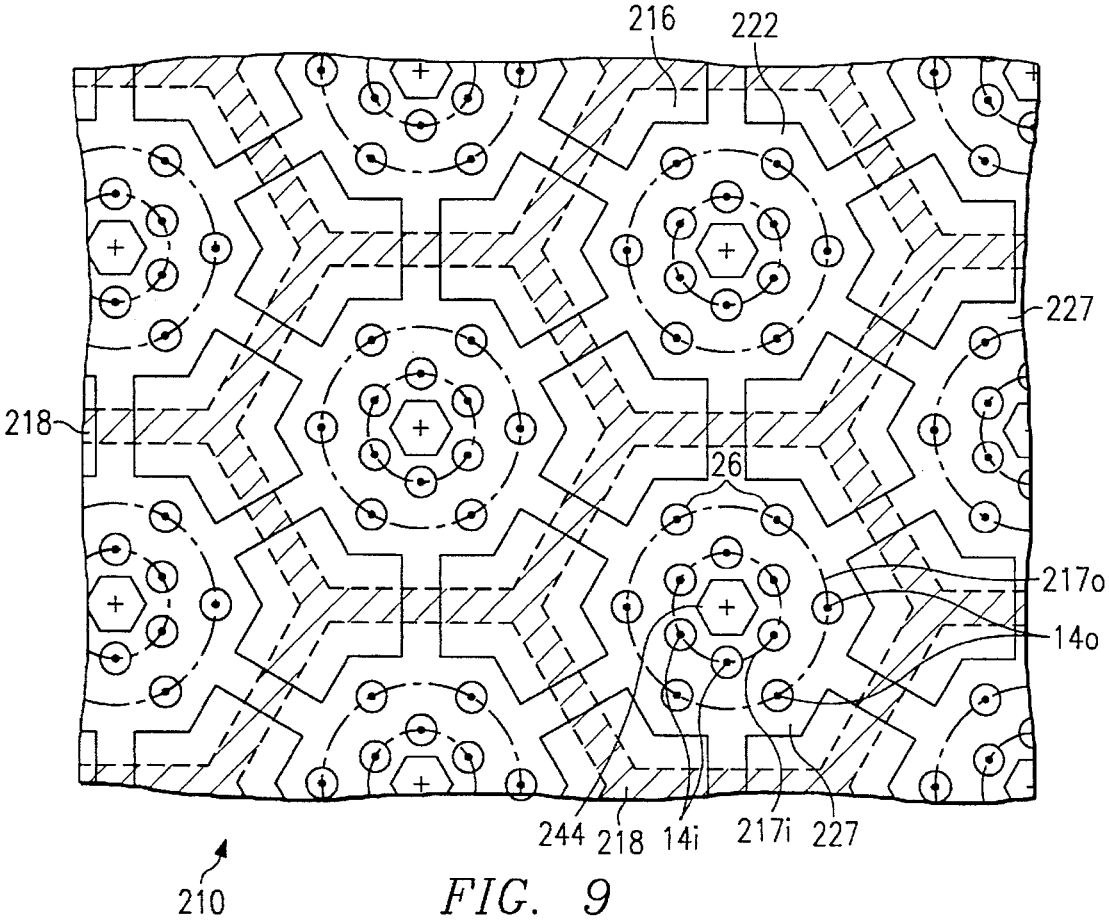

FIG. 9 shows an alternative embodiment of an electron emitter plate 210 having a mesh structure 218 defining a close-packed arrangement of hexagonal mesh spacings 216. An extraction electrode layer 222, spaced from mesh structure 218 and a resistive layer 15 by an intervening dielectric layer 25, is patterned to form hexagonal pads 227 concentrically located within mesh spacings 216, with a uniform marginal separation existing between the pads 227 and mesh structure 218. Apertures 26, located on one or more circles **217*i*, 217*o* concentric with mesh spacing 218, are arrayed on pads 227, and each pad 227 is ring-shaped with a central, hexagonal cutout region 244. Microtips 14*o*, 14*i* are formed on resistive layer 15 within mesh spacings 216, in one-to-one correspondence within apertures 26. Microtips 14*o*, 14*i* are arranged symmetrically about their respective circles 217*o*, 217*i* so that the same resistive path exists with respect to mesh structure 218** for all microtips of the same circle.

In the illustrated embodiments, the cathode current flows to the microtips 14 through the conductive layer 118, 218 in resistive layer 15. The ordering of the layers 15 and 118, 218 may be reversed. Other arrays of aperture clusters 123, 223 in microtip clusters 112, 212 are also possible. Moreover, a mesh may be formed in the gate electrode layer 122, 222 either instead of, or in addition to, forming the mesh in the conductive layer 118, 218.

Those skilled in the art to which the invention relates will appreciate that yet other substitutions and modifications can be made to the described embodiments, without departing from the spirit and scope of the invention as defined by the claims below.

What is claimed is:

1. An electron emitter plate comprising:

a substrate;

a first layer of conductive material deposited on said substrate; said first layer of conductive material being patterned in a mesh structure defining a mesh spacing;

a layer of insulating material deposited on said substrate over said first layer of conductive material;

a second layer of conductive material deposited on said substrate over said layer of insulating material; said second layer of conductive material being patterned to form a ring-shaped pad located centrally within said mesh spacing, at least one bridging strip connecting said pad to other parts of said second layer of conductive material, and a plurality of apertures formed in an array on said pad;

a layer of resistive material deposited on said substrate; and a conductive microtip formed in each aperture and laterally spaced by said resistive material from said mesh structure.

2. The electron emitter plate of claim 1, wherein said ring-shaped pad has an inner boundary defining a ring center; wherein said insulating material layer has a thickness; and wherein said thickness of said insulating material layer is reduced within said ring center.

3. The electron emitter plate of claim 1, wherein said mesh spacing is a circular mesh spacing, and said pad is a circular ring-shaped pad, located concentrically within said circular mesh spacing.

4. The electron emitter plate of claim 3, wherein said plurality of apertures is formed in a circle concentric with said mesh spacing.

5. The electron emitter plate of claim 1, wherein said mesh spacing is a hexagonal mesh spacing, and said pad is a hexagonal ting-shaped pad, located concentrically within said hexagonal mesh spacing.

6. The electron emitter plate of claim 1, wherein said insulating layer is formed with a cavity connecting at least two of said apertures and commonly containing at least two of said microtips.

7. The electron emitter plate of claim 1, wherein said pad has an undersurface separated by a toroidal region from said resistive layer; and said layer of insulating material is formed so that insulating material is absent from a majority of said toroidal region.

8. An image display device comprising the electron emitter plate of claim 1, and further comprising an anode plate spaced from said emitter plate and including an anode substrate, another layer of conductive material deposited on said anode substrate, and cathodoluminescent material in electrical communication with said another layer of conductive material.

9. An electron emitter plate comprising:

a substrate;

a first layer of conductive material deposited on said substrate;

a layer of insulating material deposited on said substrate over said first layer of conductive material;

a second layer of conductive material deposited on said substrate over said layer of insulating material; said second layer of conductive material having a plurality of apertures arranged in a loop and an absence of second layer conductive material within a majority of an interior of said loop; and a conductive microtip formed in each aperture in electrical communication with said first layer of conductive material.

10. The electron emitter plate of claim 9, wherein said insulating material layer has a thickness; and wherein said thickness of said insulating layer is reduced within said loop interior.

11. The electron emitter plate of claim 9, wherein said insulating layer is formed with a cavity connecting at least two of said apertures and commonly containing at least two of said microtips.

12. The electron emitter plate of claim 9, wherein said second layer of conductive material is patterned in a ring-shaped pad; said loop of apertures is a circular array of apertures located concentrically on said pad; and said second layer conductive material is absent from a circular core defined by inner boundaries of said pad.

13. An electron emitter plate comprising:

a substrate;

a first layer of conductive material deposited on said substrate; said first layer of conductive material being patterned in a mesh structure defining a hexagonal mesh spacing;

a layer of insulating material deposited on said substrate over said first layer of conductive material;

a second layer of conductive material deposited on said substrate over said layer of insulating material; said second layer of conductive material being patterned to form a hexagonal pad located concentrically within said mesh spacing, at least one bridging strip connecting said pad to other parts of said second layer of conductive material, and a plurality of apertures formed in an array on said pad;

a layer of resistive material deposited on said substrate; and a conductive microtip formed in each aperture and laterally spaced by said resistive material from said mesh structure.

14. The electron emitter plate of claim 13, wherein said plurality of apertures is formed in a circle concentric with said mesh spacing.

15. The electron emitter plate of claim 13, wherein said hexagonal pad is a ring-shaped pad having an inner boundary defining a ring center.

16. The electron emitter plate of claim 15, wherein said inner boundary is hexagonal.

17. The electron emitter plate of claim 15, wherein said insulating material layer has a thickness; and wherein said thickness of said insulating layer is reduced within said ring center.

18. The electron emitter plate of claim 15, wherein said insulating layer is formed with a cavity connecting at least two of said apertures and commonly containing at least two of said microtips.

19. An electron emitter plate comprising:

a substrate;

a first layer of conductive material deposited on said substrate; said first layer of conductive material being patterned in a mesh structure defining a plurality of mesh spacings;

a layer of insulating material deposited on said substrate over said first layer of conductive material;

a second layer of conductive material deposited on said substrate over said layer of insulating material; said second layer of conductive material being patterned to form a pad located centrally within each said mesh spacing, at least one bridging strip connecting each pad to two other pads, and a plurality of apertures formed on each pad;

a layer of resistive material deposited on said substrate; and a conductive microtip formed in each aperture and laterally spaced by said resistive material from said mesh structure.

20. The electron emitter plate of claim 19, wherein said mesh spacings are arranged in hexagonal close-packed relationships.

21. The electron emitter plate of claim 19, wherein lines joining centers of said mesh spacings form equilateral triangles having centers; and wherein said first layer of conductive material is further patterned so that first layer conductive material is absent from said equilateral triangle centers.

22. The electron emitter plate of claim 21, wherein said at least one bridging strips are Y-shaped strips having central nodes passing over said equilateral triangle centers.

23. The electron emitter plate of claim 22, wherein said pads are ring-shaped pads having inner boundaries defining ring centers; wherein said insulating material layer has a thickness; and wherein said thickness of said insulating material layer is reduced within said ring center.

24. The electron emitter plate of claim 23, wherein each pad has an undersurface separated by a toroidal region from said resistive layer; and said layer of insulating material is formed so that insulating material is absent form a majority of each said toroidal region.

25. An electron emitter plate comprising:

a substrate:

a first layer of conductive material deposited on said substrate; said first layer of conductive material being patterned in a mesh structure defining a plurality of mesh spacings; said mesh spacings being arranged in hexagonal close-packed relationships wherein lines joining centers of said mesh spacings form equilateral triangles having centers; and said first layer of conductive material being patterned so that first layer conductive material is absent from said equilateral triangle centers;

a layer of insulating material deposited on said substrate over said first layer of conductive material;

a second layer of conductive material deposited on said substrate over said layer of insulating material; said second layer of conductive material being patterned to form a pad located centrally within each said mesh spacing, at least one bridging strip connecting each pad at least one other pad, and a plurality of apertures formed on each pad;

a layer of resistive material deposited on said substrate; and a conductive microtip formed in each aperture and laterally spaced by said resistive material from said mesh structure.

* * * * *